United States Patent [19]

Friedenthal

[11] 4,083,557

[45] Apr. 11, 1978

[54] REUSABLE KARATE STRIKING BOARD

[76] Inventor: Robert Friedenthal, 43 Liberty Square Rd., Boxboro, Mass. 01719

[21] Appl. No.: 717,566

[22] Filed: Aug. 26, 1976

Related U.S. Application Data

[63] Continuation-in-part of Ser. No. 643,604, Dec. 22, 1975, abandoned.

[51] Int. Cl.[2] ..... A63J 5/00

[52] U.S. Cl. ..... 272/76

[58] Field of Search ..... 272/76, 8 N; 273/102 A, 273/102 AP, 105.4; 46/26, 24, 16, 17, 31; 428/57, 58, 131, 133

[56] References Cited

U.S. PATENT DOCUMENTS

| | | | |
|---|---|---|---|
| 3,032,919 | 5/1962 | Amsler | 46/26 |
| 3,973,772 | 8/1976 | Milliken | 272/76 |
| 4,004,799 | 1/1977 | Kundert | 272/76 X |

FOREIGN PATENT DOCUMENTS

| | | | |
|---|---|---|---|
| 1,330,922 | 12/1963 | France | 428/133 |
| 427,207 | 6/1967 | Switzerland | 46/26 |
| 3,182 of | 1907 | United Kingdom | 428/58 |

*Primary Examiner*—Richard J. Apley
*Assistant Examiner*—T. Brown
*Attorney, Agent, or Firm*—Morse, Altman, Oates & Bello

[57] ABSTRACT

A karate practice board for subjection to hand and foot strikes, simulates frangibility and permits reassembly by means of a multi-component structure that is characterized by a special tongue and groove relationship.

The practice board is made of first and second parts, the parts being along a longitudinal edge thereof by a tongue and groove joint. The first part having a tongue and groove configuration along one of its edges and the second part having a tongue and groove configuration along one of its edges. The configuration of the parts are seen to be a mirror image of each other when the parts are joined by the configuration to form the board. The strength of the material of the board is such that shattering of the parts along the mating edge is avoided when the parts are separated as a result of impact by a user.

10 Claims, 3 Drawing Figures

REUSABLE KARATE STRIKING BOARD

RELATED APPLICATION

The present application is a continuation-in-part of application Ser. No. 643,604, filed Dec. 22, 1975 abandoned.

BACKGROUND OF THE INVENTION

1. Field of the Invention

The present invention relates to practice equipment for the martial arts and, more particularly, to a novel karate practice board for hand and foot strikes.

2. The Prior Art

Karate practitioners frequently break wooden boards or like members in order to develop and demonstrate powerful hand and foot strikes. One board or a stack of boards is supported at opposite edges, generally with its grain running parallel to these edges, and is struck medially by the foot or the hand. If the strike is sufficiently powerful and properly executed, the board or boards will break in two. In the past, boards thus broken have been discarded. Since a typical practitioner thus may destroy many boards each day, as many as 10 2.5 centimeter boards at a single blow, karate practice can be unduly expensive. Also, wooden boards tend to vary unpredictably in their resistance to severing force so that, in the past, the karate practitioner has had no calibrated guage of the force he is capable of delivering.

SUMMARY OF THE INVENTION

The primary object of the present invention is to provide a karate practice board, for subjection to hand and foot strikes, comprising at least two parts, which are releasably joined by tongue and groove configurations that enable the parts to be mated repeatedly but to be severed ostensibly. Mating merely involves sliding the tongue and groove configurations into engagement. Severing involves striking the assembled board with predeterminedly great force in the vicinity of its tongue and groove joint. Since the board parts preferably are composed of a relatively resilient plastic and since there is no actual disintegration, harm to the hand or foot by splinters or the like is avoided.

Another object of the present invention is to provide a kit of boards of the foregoing type that are calibrated to sever upon the application of different forces. This kit permits the karate practitioner to gauge the precise force of his strikes and to develop his skill and force methodically.

Other objects of the present invention will in part be obvious and will in part appear hereinafter.

The invention accordingly comprises the product, together with its parts and their relationships, which are exemplified in the accompanying disclosure, the scope of which will be indicated in the appended claims.

BRIEF DESCRIPTION OF THE DRAWINGS

For a fuller understanding of the nature and objects of the present invention, reference is made to the following detailed description, taken in connection with the accompanying drawings, wherein.

DETAILED DESCRIPTION OF THE PREFERRED EMBODIMENT

Figure 1:
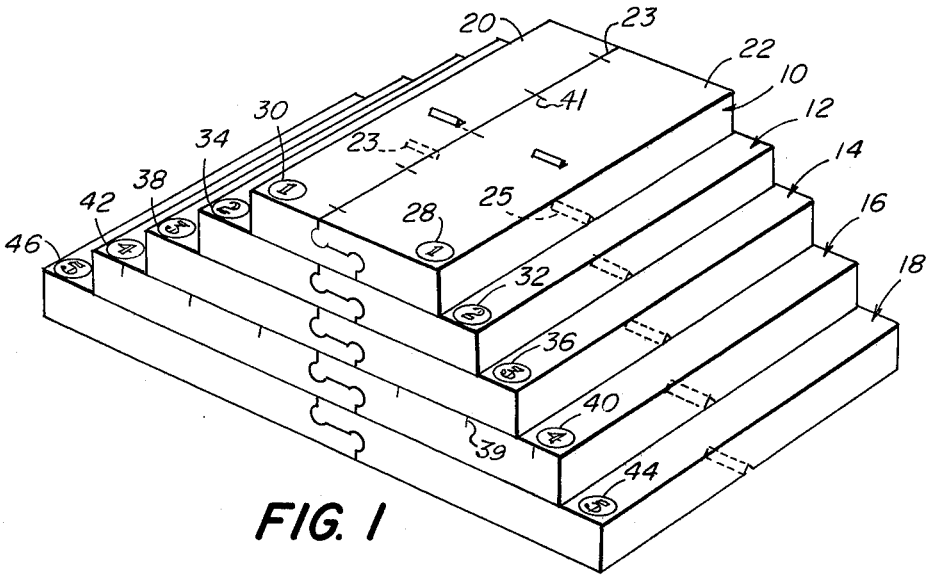
FIG. 1 is a perspective illustration of a kit of calibrated boards embodying the present invention.
Figure 3:
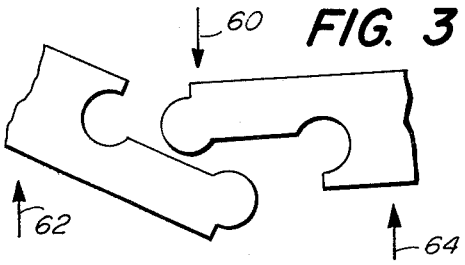
FIG. 3 is a cross-sectional view, partly broken away, of the board of FIG. 2, with its components severed, after being subjected to a karate strike.

Generally, the kit of FIG. 1 comprises a plurality of boards, 10, 12, 14, 16, 18, each having a pair of parts 20, 22. Each pair of parts is firmly but severably mated together by a tongue and groove joint 23, which can be mated repeatedly by sliding engagement and severed repeatedly by striking. Severing is accomplished, in effect, by the exertion of upward supporting forces at the ends of the board and a downward striking force at the joint, by which the gripping forces between the parts 20, 22 is overcome. The arrangement is such that the two parts, at least in the vicinity of their joint, are composed of materials that are sufficiently strong and sufficiently resilient to deform and to disengage without fragmentation when their gripping forces are overcome.

In a preferred form, the two parts of the board are composed of a resilient polymer, particularly an elastomer such as a hard rubber (for example neoprene or polyisobutylene) of a solid foam, particularly a microcellular foam (for example closed cell polyethelene foam). Preferably, each of boards 10, 12, 14, 16, 18 ranges: in length from 10 to 40 centimeters (4 to 16 inches; in width from 5 to 20 centimeters (2 to 8 inches); and in thickness from 0.5 to 5.0 centimeters (0.2 to 2.0 inches). In each case, the tongue and groove joint extends transversely across the board and each of the two parts of a board is approximately the same length, width and thickness as the other.

In accordance with the present invention, members 10, 12, 14, 16, 18 have tongue and groove junctions of increasing gripping strengths. In other words, the striking force necessary for severing member 12 is greater than that for member 10, etc. Each part 20, 22 of each of members 10, 12, 14, 16, 18 is provided with corresponding indicia. Thus: the parts of member 10 are provided with indicia 29, 30; the parts of member 12 are provided with indicia 32, 34; the parts of member 14 are provided with indicia 36, 38; the parts of member 16 are provided with indicia 40, 42; and the parts of member 18 are provided with indicia 44, 46. In another embodiment, the members have gradually increasing widths so that their junctions are of gradually increasing lengths and, therefore, exert the aforementioned increasing gripping forces. As shown each of the boards has ribs 19, 21 at its upper face extending in alignment from a point spaced from junction 23 to the opposite extermities of the board and notches 23, 25 at its lower face extending in alignment from a point spaced from junction 23 to the opposite extremities of the board. These ribs and notches facilitate alignment of the boards of the kit in a multiple board assembly for multiple board strikes when desired. All of the members have the same specific gravity, namely, approximately that of wood in the range of from 0.4 to 1.5 grams per cubic centimeter.

Figure 2:
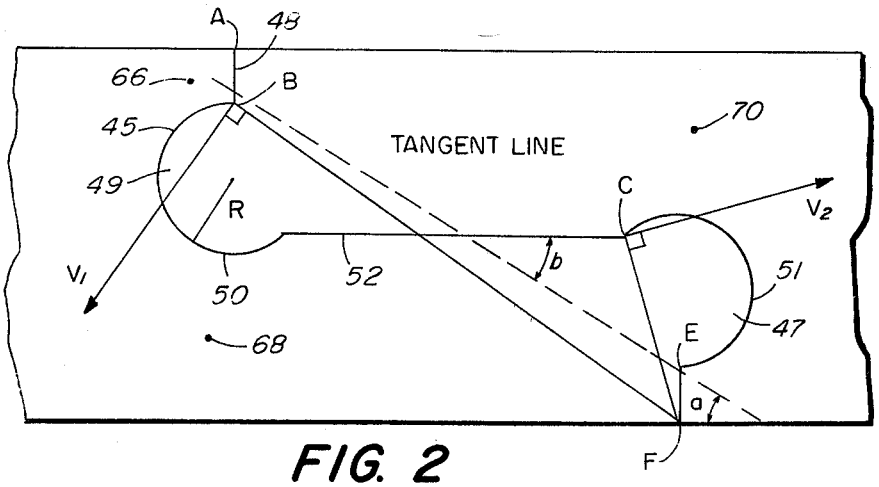
FIG. 2 is a cross-sectional view, partly broken away, of a board, with its components mated, embodying the present invention.

A preferred tongue and groove configuration is shown in FIG. 2 as being defined by a first groove 45 and a first tongue 47 in one of the parts and a second tongue 49 and a second groove 51 in the other of the parts. These mating configuration are mirror images of one another. These parts are formed in the same mold and simply are reversed to provide mating configurations. Each configuration, in cross section, is defined by a line 48 that is approximately perpendicular to a first face of the part, a frustocircular profile 50, a line 52 that is parallel to the direction of elongation of the member, a frusto-circular profile 54, and a line 56 that is approximately perpendicular to the other face of the part. Tongues 47, 49 project in generally opposite directions and grooves 45, 51 generally open in opposite directions. In practice, when a striking force 60 is exerted at the junction of a board supported at 62, 64, this force is exerted at point F. A resultant force vector may be derived for any point on the joint by drawing a line from a fulcrum to that point and constructing the force vector at right angles to that line. At points B and C, such vectors indicate that forces operate through each frustro-circle to cause tension. To relieve this tension, points B and C move around the circumferences of these frustro-circles, causing stress in areas 66, 68, 70. Such movement, if continued, causes the frustro-circular grooves to widen enough for the frustro-circular tongue to escape suddenly. The amount of striking force necessary to cause separation depends on the resistance of the grooves to opening and the resistance of the tongues to deformation. Generally, for severing, the karate strike at the joint must generate bending moments capable of overcoming the reverse forces established by the rigidity, i.e. the modulus of shear, of the material of which the parts are composed. And the shear strength of the material must be sufficiently great to preclude fragmentation when subjected to such bending moments. In the illustrated embodiment, the following factors increase needed striking force by requiring greater separation: (1) decreasing angle B; and (2) moving point A to the right. And the following factors increase resistance to deformation: (1) greater rigidity of the material; and (2) increasing the length of line B–A. The angle at which vectors $V_1$ and $V_2$ attack the frustro-circular profiles determines the difficulty of causing pivotal movement around the profiles and, therefore, the resistance to separation. Decreasing angle A, the angle of the line to which the two frustro-circular profiles are tangent, causes $V_1$ to attack more directly, increasing resistance, and $V_2$ to attack less directly. It is preferred that angle A be set so that the two angles of attack are approximately equal, stress thereby being shared equally between the two halves of the joint. At points E and D, no tension is generated. Force is exerted at points B and C, at the inside of one frustro-circle and at the outside of the other. Such a distribution of forces is similar to that generated when a single tongue and groove joint is pulled apart rather than bent. In such a joint, resistance to separation by pulling tension is far greater than by bending moment. In the illustrated embodiment, the edge of board 16 perpendicular to the junction is provided with indicia 39 in such a way as to indicate different support positions by which different striking forces can be established with this single board. Similarly, the edge of board 10 along the junction is provided with indicia 41 along the junction so as to indicate different relative positions of the two parts of the board longitudinally of the junction by which different striking forces can be established with this single board.

OPERATION

In operation, a karate practitioner can strike the members of the kit of FIG. 1 sequentially in order to gauge his comfortable striking force and then can practice with a selected member of the kit repetitively by alternately mating and striking.

Since certain changes may be made in the foregoing disclosure without departing from the scope of the invention herein, it is intended that all matter shown in the foregoing disclosure or in the accompanying drawings be interpreted in an illustrative and not in a limiting sense.

What is claimed is:

1. A striking board comprising at least a first part and a second part, said first part having a first configuration at one of its edges, said second part having a second configuration at one of its edges, said first configuration and said second configuration being mirror images of one another, said first configuration and said second configuration being matched to form an elongated junction in order to mate and hold said first part and said second part only mechanically, said first configuration and said second configuration, when separated, being such as to permit said first configuration and said second configuration to be mated by sliding motion longitudinally of said elongated junction, said first configuration and said second configuration, when mated, being such at to permit said first configuration and said second configuration to be separated by an impact applied perpendicularly with respect to said elongated junction, the strength of said first configuration and said second configuration being sufficiently great to avoid shattering along said elongated junction as a result of said impact.

2. The striking board of claim 1 wherein the shear strength at said junction is sufficient to maintain the integrity of said first and second configurations when subjected to forces sufficient to sever said first part and said second part.

3. The striking board of claim 1 wherein said first configuration in cross-section includes at least a curved tongue profile and said second configuration includes at least a curved groove profile.

4. The striking board of claim 1 wherein said first configuration in cross-section includes at least a frustro-circular tongue profile and said second configuration in cross-section includes at least a frustro-circular groove profile.

5. The striking board of claim 1 wherein said first configuration in cross-section includes a first tongue profile and a first groove profile and said second configuration includes a second tongue profile and a second groove profile, said first tongue profile and said second groove profile being of like shape, said second tongue profile and said first groove profile being of like shape.

6. A kit of striking boards, each of said striking boards comprising at least a first part and a second part, said first part having a first configuration at one of its edges and a visual indicium thereon, said second part having a second configuration and a visual indicium thereon, said first configuration and said second configuration being mirror images of one another, said first configuration and said second configuration being matched to form an elongated junction in order to mate and hold said first part and said second part only mechanically, said first configuration and said second configuration, when separated, being such as to permit said first configuration and said second configuration to be mated by sliding motion longitudinally of said elongated junction, said first configuration and said second configuration, when mated, being such as to permit said first configuration and said second configuration to be separated by an impact applied perpendicularly with respect to said elongated junction, the strengths of said first configuration and said second configuration being sufficiently great to avoid shattering along said elongated junction as a result of said impact, said visual indicium of said first part corresponding to said visual indicium of said second part, said sufficient force in the case of each of said striking boards being different from said sufficient force in the case of others of said striking boards, the visual indicia of each of said striking boards being different from the visual indicia of others of said striking boards.

7. The kit of striking boards of claim 6 wherein the shear strength at said junction is sufficient to maintain the integrity of said first and second configurations when subjected to forces sufficient to sever said first part and said second part.

8. The kit of striking boards of claim 6 wherein said first configuration in cross-section includes at least a curved tongue profile and said second configuration includes at least a curved groove profile.

9. The kit of striking boards of claim 6 wherein said first configuration in cross-section includes at least a frustro-circular tongue profile and said second configuration in cross-section includes at least a frustro-circular groove profile.

10. The kit of striking boards of claim 6 wherein said first configuration in cross-section includes a first tongue profile and a first groove profile and said second configuration includes a second tongue profile and a second groove profile, said first tongue profile and said second groove profile being of like shape, said second tongue profile and said first groove profile being of like shape.

* * * * *